United States Patent [19]

Brown

[11] 4,257,082

[45] Mar. 17, 1981

[54] MAGNETIC FLIP-FLOP FOR HYDROPHONE PREAMPLIFIER

[75] Inventor: Craig K. Brown, Winter Garden, Fla.

[73] Assignee: The United States of America as represented by the Secretary of the Navy, Washington, D.C.

[21] Appl. No.: 95,111

[22] Filed: Nov. 16, 1979

[51] Int. Cl.[3] ..... H01H 47/00

[52] U.S. Cl. ..... 361/191; 361/156; 361/186

[58] Field of Search ..... 361/156, 186, 191, 167, 361/168; 340/310 R, 310 A, 288

[56] References Cited

U.S. PATENT DOCUMENTS

| | | | |
|---|---|---|---|
| 2,678,411 | 5/1954 | Hufnagel | 361/186 |
| 2,703,532 | 3/1955 | Bobo | 361/191 X |
| 2,837,700 | 6/1958 | Brown | 361/156 |
| 3,174,080 | 3/1965 | Scott | 361/168 X |
| 3,365,622 | 1/1968 | Pearse | 361/167 X |
| 3,365,625 | 1/1968 | Pearse | 361/167 X |
| 3,500,132 | 3/1970 | Garrett | 361/186 |
| 3,931,551 | 1/1976 | Holt | 361/156 |

*Primary Examiner*—J. D. Miller
*Assistant Examiner*—L. C. Schroeder
*Attorney, Agent, or Firm*—R. S. Sciascia; William T. Ellis

[57] ABSTRACT

A magnetic flip-flop circuit, predominantly used for hydrophone preamplifiers, which allows switching capabilities at a remote location while minimizing the number of conductors. In particular, the circuitry is a magnetic flip-flop system which has a multiple-pole, double-throw latching magnetic relay in combination with a single-pole, nonlatching magnetic relay. The combination is coupled to allow a switching of the magnetic latching relay by merely removing the voltage from a single conductor.

13 Claims, 3 Drawing Figures

MAGNETIC FLIP-FLOP FOR HYDROPHONE PREAMPLIFIER

BACKGROUND OF THE INVENTION

The present invention relates generally to improvements in hydrophones and more particularly pertains to a new and improved hydrophone preamplifier wherein one or more switches are housed in the preamplifier and controlled remotely without any increase in the number of conductors in the hydrophone cable.

Hydrophones may be thought of an underwater microphones. They convert acoustic signals in water into electrical signals for transmission through a cable to some listening device. Electronic preamplifiers are generally used to boost the signal level and provide an impedance-match to the cable. These preamplifiers are miniaturized and contained in the hydrophone housing.

Many modern hydrophone designs use a cable that consists of only two wires. This reduces the physical bulk and cost of the cable. Since the preamplifier requires DC supply current to operate and it produces an AC audio output signal, it is designed so that these share the common two-wire cable.

It is often necessary to have a relay in a hydrophone preamplifier. For example, a relay is often used to switch the preamplifier input circuit from the actual hydrophone crystal to a "dummy" hydrophone (usually a capacitor). This allows the system noise to be checked at the end of the cable. Sometimes a relay is used to change the gain of the preamplifier or to switch in a special filter. Occasionally one wishes to switch on a special signal source, such as an oscillator for calibration purposes.

In the past, inclusion of such a switch in the hydrophone preamplifier has required the addition of a control wire in the hydrophone cable. Placing a positive or negative voltage on this control wire would cause the relay to change state. Because of the need for this extra control wire, relays could not generally be used in two-wire hydrophone designs. The present invention eliminates this problem.

OBJECTS OF THE INVENTION

An object of the invention is to provide a circuit which allows circuit switching in remote locations while minimizing the number of cable conductors.

Another object is to provide a hydrophone preamplifier with a magnetic flip-flop in which two conductors carry circuit power, ground, signal output and switching commands.

A further object is to provide a relay which switches upon removal of the voltage from a single conductor.

A still further object is to provide a remotely operated switch in a two-wire hydrophone preamplifier that is simple, compact, easy to manufacture and requires very little power.

Yet another object is to provide a relay in a remote hydrophone which can be switched into a known state upon reversal of the power and ground conductors.

SUMMARY OF THE INVENTION

The above and other objects are attained by the inclusion of a multiple-pole, double-throw, magnetic latching relay and a control circuit which causes a storage capacitor to charge when voltage is applied to the cable conductor. The poles of the relay are switched into the opposite state by discharging the charged capacitor into the appropriate coil. Reversal of the power and ground conductors causes the poles of the relay to switch into a known state.

BRIEF DESCRIPTION OF THE DRAWINGS

Other objects and many of the attendant advantages of the invention will be readily appreciated as the same becomes better understood by reference to the following detailed description when considered in connection with the accompanying drawings in which like reference numerals designate like parts throughout the figures thereof and wherein.

DETAILED DESCRIPTION OF THE INVENTION

Figure 1:
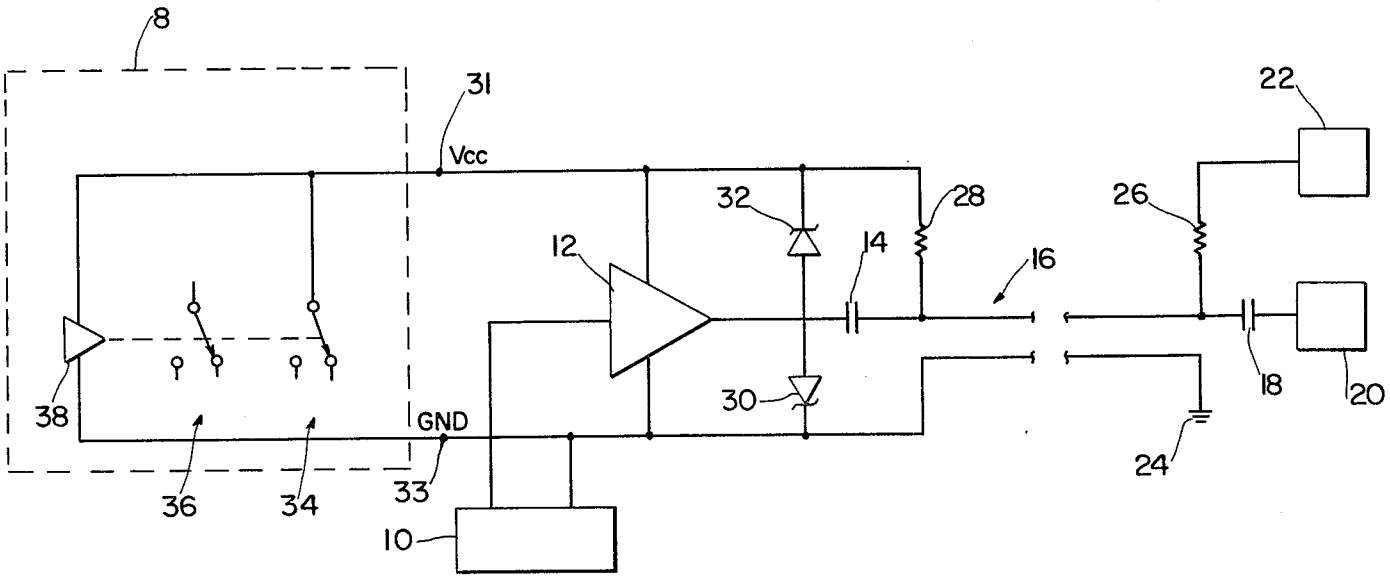
FIG. 1 shows a schematic diagram of a typical two-wire hydrophone system, with the added magnetic flip-flop.

Referring now to FIG. 1, a typical prior-art hydrophone system is shown. A hydrophone crystal 10 converts the impinging sound waves (not shown) to electrical signals and feeds them to an amplifier 12. After amplification, the signals are fed through a direct-current blocking capacitor 14 to the hot conductor of a two-conductor cable 16. At the other end of the cable 16, the signals pass through another direct-current blocking capacitor 18 to a signal receiver 20. The purpose of the two capacitors 14 and 18 is to prevent DC power from mixing with the crystal signals anywhere but on the cable itself. A DC operating voltage is supplied by a power supply 22 and fed through a dropping resistor 26 to the same hot conductor of cable 16. On the amplifier end of the cable 16, the DC voltage is blocked from the amplifier 12 by the capacitor 14 and fed through an isolation resistor 28 to the supply voltage input of the amplifier 12. The function of the two isolation resistors 26 and 28 is to present a high impedance to the signal, relative to that of the capacitors 14 and 18 at the frequencies of interest, thus insuring separate paths for the DC supply voltage and the hydrophone signal. Connected in series opposition across the voltage input and ground terminals of amplifier 12 are two zener diodes 30 and 32, their anodes connected together so as to form a voltage regulator. The signal return of the hydrophone crystal 10, and the ground lead of the amplifier 12 are each connected to the system ground 24 through the ground conductor of the cable 16.

The present invention adds to the above circuitry, a magnetic flip-flop 8, connected across the DC power (Vcc) lead 31, and ground lead 33 of the amplifier 12. Shown are a control unit 38, a dedicated pole 34 and a non-dedicated pole 36. For the sake of convenience, only one non-dedicated pole is shown in the drawings, and described herein. The dedicated pole 34, as will be later seen, is not available for switching purposes. It is, instead, used for purposes internal to the magnetic flip-flop 8. The non-dedicated poles are available for other purposes.

Figure 2:
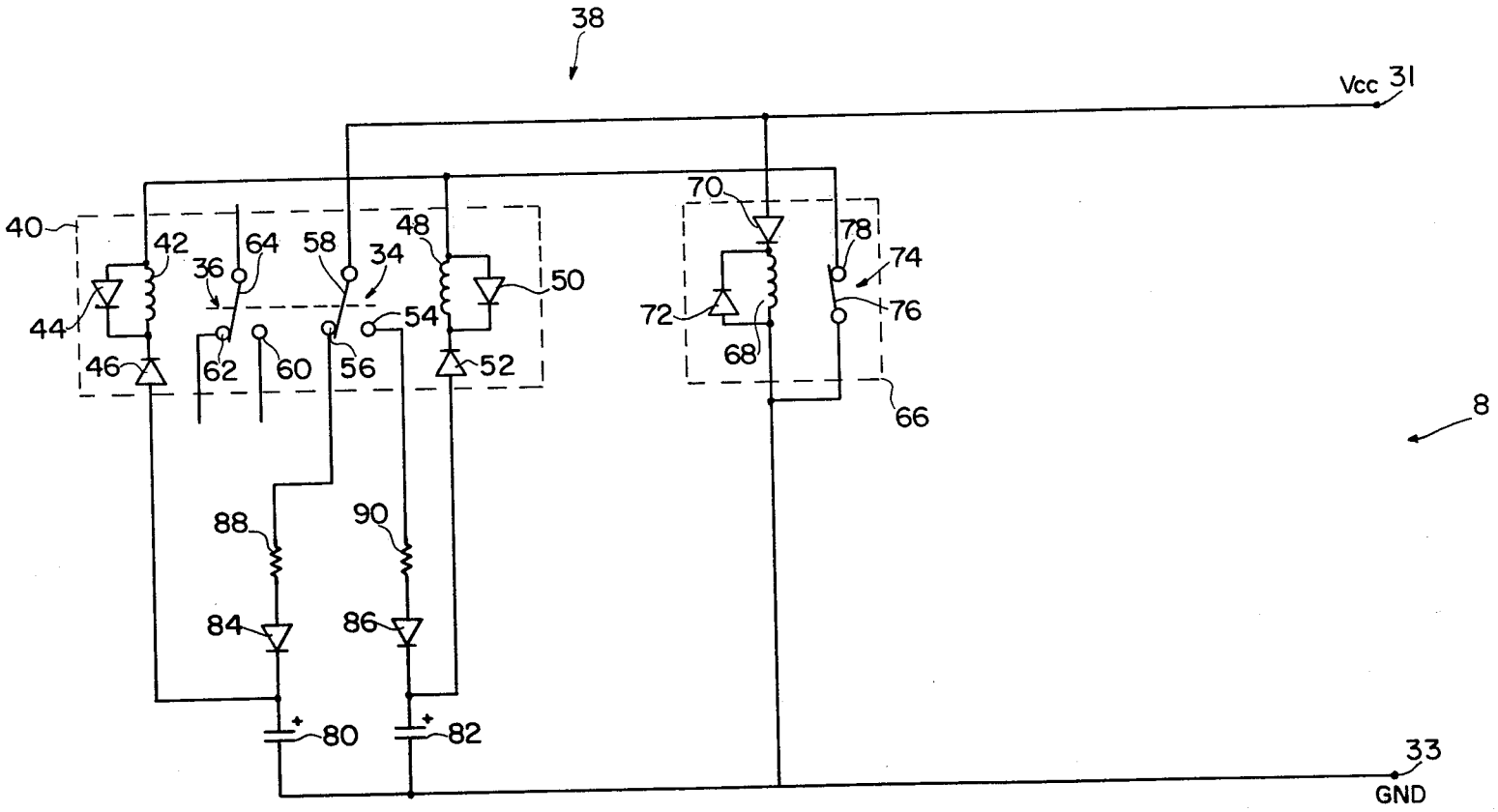
FIG. 2 shows a schematic diagram of the magnetic flip-flop.

Referring now to FIG. 2, the control circuitry 38 of the magnetic flip-flop 8 is shown with switches 34 and 36 included as part of the circuitry whereas FIG. 1 showed them as separate elements. The DC power (Vcc) lead 31 of the amplifier, not shown, is connected to the anode of a diode 70 which is part of a normally closed SPST magnetic relay 66. This relay 66 should be chosen so as to switch to an open condition whenever a voltage of at least half of the applied voltage appears across its coil. In that way, the open condition can be sustained with only a few volts appearing across the coil.

The cathode of diode 70 is connected to ground through a parallel combination of a relay coil 68 and inversely connected diode 72. The two diodes 70 and 72 are commonly known as internal diodes of the normally closed SPST magnetic relay 66 and their functions will be detailed later. The switch 74 has its pole 76 grounded while the stationary contact 78 is connected to both coils 42 and 48 of a DPDT latching magnetic relay 40. For each coil 42 and 48 there is a cathode of diodes 46 and 52, respectively, connected in series thereto. Paralleled across each coil 42 and 48 is a diode 44 and 50, respectively, connected such that the cathodes of the parallel diodes 44 and 50 are connected, respectively, to the cathodes of the series diodes 46 and 52. Again, these diodes are part of the DPDT latching magnetic relay 40, and are known as internal diodes.

The function of these three sets of internal diodes is to protect the respective coils. The paralleled diodes 44, 50 and 72 are used to prevent a transient voltage from building up across the coils 42, 48 and 68 respectively, when the current flowing through the coils abruptly falls to zero. This transient voltage develops across the coils so as to tend to maintain the current flow through the coils. The diodes 44, 50 and 72 clamp that voltage to a value of approximately 1 volt. The series diodes 46, 52 and 70 prevent damaging reverse currents from flowing through the coils 42, 48 and 68 respectively.

The pole 58 of the dedicated switch 34 is connected to supply power at the anode of the diode 70. The stationary contacts 54 and 56 are each connected to the system ground through identical series combinations of a resistor 88 and 90, a forward-poled diode 84 and 86, and a capacitor 80 and 82, respectively. The negative side of each capacitor 80 and 82 is grounded, and their respective positive sides are each connected to the cathode of a different diode 84, and 86 respectively, and to the anodes of the internal diodes 46 and 52, respectively, of the DPDT latching magnetic relay 40. The capacitors 80 and 82 should have capacitances on the order of several microfarads or more. This large capacity is necessary so that the discharge voltage can be sustained for a sufficient period of time so as to cause the latching relay 40 to switch. The required time for switching is on the order of 1—2 milliseconds.

The nondedicated switch 36, which has a pole 64 and two stationary contacts 60 and 62, is not connected at all; it is available for any switching purposes. A DPDT latching magnetic relay 40 has been described, but it is understood that a multiple-pole, double throw, latching magnetic relay can be used, in which case all switches except the one dedicated switch are available for switching purposes. Relay 66 may also be a SPDT nonlatching magnetic relay in which case the normally closed set of contacts are used.

In operation, when there is no voltage applied to the magnetic flip-flop 8, the normally closed relay 66 is closed, capacitors 80 and 82 are uncharged and the pole 58 of dedicated switch 34 is latched from a prior operation to one of the two stationary contacts 54 or 56. Assume the pole 58 is latched to stationary contact 56. When power is applied to the magnetic flip-flop through Vcc lead 31, it may either be switched on to full value or slowly brought up to the nominal value such as where the supply voltage is increased by turning a knob on the power supply 22 (shown in FIG. 1). The rise time of the applied voltage is unimportant. Thus when power is applied to the magnetic flip-flop 8, the voltage across it begins to rise toward the nominal value of the applied voltage and current flows along three paths to ground. Current flows through the pole 58 and the stationary contact 56 of the switch 34, through the resistor 88, the diode 84 thus forward-biasing the diode and then splits into two paths. The first path is through the capacitor 80 to ground, thus charging the capacitor. The second path is through the diode 46, forward biasing that diode, and the coil 42 of the relay 40, through stationary contact 78 and the pole 76 of switch 74 to system ground through ground lead 33 and the cable 16 of FIG. 1. Diode 44 is reverse-biased so only a small leakage current flows through it. The resistor 88 limits the current flowing through the coil 42 to a level insufficient to switch the relay 40. The third current path is from the applied voltage through the diode 70 and the coil 68 of the relay 66 to system ground also through ground lead 33 and the cable 16 of FIG. 1. At this point the voltage across the coil 68 is insufficient to cause switch 74 to open.

As the applied voltage continues to increase, the voltage across the coil 68 will become sufficient to cause switch 74 to open. At this point, the current flowing through the diode 46 and the coil 42 will fall to zero. The coil 42 will develop a transient voltage across it which will tend to maintain the magnitude and direction of the current flow. In doing so, the coil 42 in effect becomes a source. This voltage is the destructive reverse voltage that was mentioned earlier and to protect against it, the paralleled diode 44 is then forward-biased and consequently limits this reverse voltage to approximately a volt, a level where internal mechanical damage will not occur in the relay 40.

Current still flows through the pole 58, the series resistor 88, the series diode 84 and the series capacitor 80, and as the applied voltage increases to its nominal value, the capacitor 80 will then be charged such that the voltage on the positive side equals the value of the applied voltage Vcc. Current through this path will then fall to a value equal to the leakage current that flows from the positive side of the capacitor 80 to ground but for all practical purposes, it can be considered to be zero. Current continues to flow along the path consisting of the diode 70 and the coil 68 of the relay 66, which will maintain the switch 74 in the open condition.

In order to cause the magnetic flip-flop to change state, the power supply voltage must be removed and the hot conductor of cable 16 should be either open-circuited or grounded. The fall time of the voltage is unimportant. The voltage across the coil 68 of the normally closed relay 66 will then follow the fall time of the applied voltage in its fall to zero voltage, but until that voltage falls to within several volts of ground potential, relay 66 remains open. Once the voltage across the coil 68 falls sufficiently, the relay 66 closes, thus completing a circuit for the charge stored in capacitor 80 to discharge through coil 42 of the magnetic latching relay 40. This surge of current results in sufficient voltage across the coil 42 to cause the switches 34 and 36 to switch to stationary contacts 54 and 60. Both dedicated and non-dedicated poles have now been switched.

On the next application of power to the magnetic flip-flop 8 a similar sequence of events will occur involving the circuit elements associated with stationary contact 54. Thus, current will flow through the pole 58, the series resistor 90, the series diode 86 when it then splits into two paths: one through the capacitor 82 to ground and the other through the diode 52, the coil 48 of the latching relay 40 and through the switch 74 to system ground via the ground lead 33 and the cable 16 of FIG. 1. When the switch 74 opens, the current through the latter path falls to zero. The series capacitor 82 then completes its charging and the voltage on its positive side equals the nominal value of the applied voltage Vcc. When the applied voltage is removed, the capacitor 82 will then discharge through the coil 48 and cause the switches 34 and 36 of the relay 40 to switch back to the stationary contacts 56 and 62, respectively. The diodes 84 and 86 prevent the capacitors 80 and 82, respectively, from discharging through the resistors 88 and 90, respectively, after the applied voltage Vcc is removed and before the movable contact 58 of relay 40 is switched to the opposite stationary contact, either 56 and 54, as the case may be.

Figure 3:
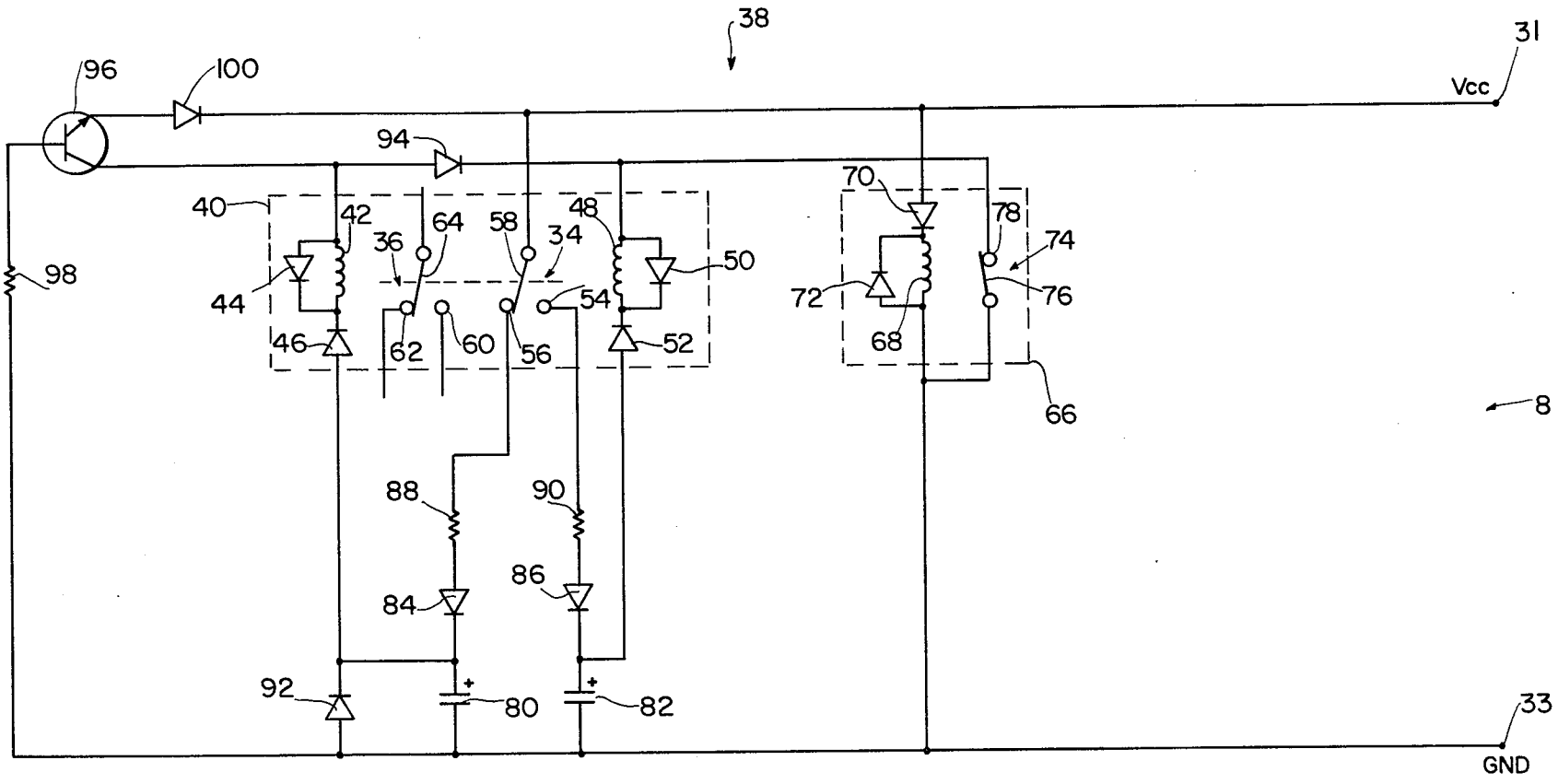
FIG. 3 shows a schematic diagram of the magnetic flip-flop with the state-forcing circuitry.

In many applications, it would be useful to have the capability of forcing the magnetic flip-flop into a certain state. It would be particularly useful in a hydrophone array where there might be many of the flip-flops in use. The second embodiment of the invention, as shown in FIG. 3, has several components added to the first embodiment so as to force the poles 34 and 36 of the magnetic latching relay 40, to the stationary set of contacts 54 and 60, respectively. A diode 92 is inversely connected across the capacitor 80, such that the anode of the diode is connected to the system ground lead 33. Another diode 94 is inserted between the coil 42 of the latching magnetic relay 40 and the stationary contact 78 of the relay 66, with the diode having its anode connected to the coil. The connection between the stationary contact 78 of relay 66 and coil 48 of the latching relay 40 is not affected. An NPN transistor 96 has its collector connected to the anode of the diode 94, its base connected through a resistor 98 to system ground via ground lead 33 and the cable 16 of FIG. 1 and its emitter connected to the anode of a diode 100 which has its cathode connected to the anode of the diode 70 of the relay 66.

In operation, assume that the position of the poles 34 and 36 of the latching relay 40 is unknown and no power is being applied to the circuit so the capacitors 80 and 82 are in an uncharged state. When reversed power is applied, that is, power supply 22 and the ground 24 are interchanged so that in effect Vcc lead 31 is grounded and DC power is applied to ground lead 33, current flow through coil 68 of relay 66 is blocked by reverse-biased diode 70, and pole 74 remains closed. Transistor 96 is turned on making it appear as a closed switch. Current then flows through forward-biased diodes 92 and 46, coil 42, transistor 96 and forward-biased diode 100, thus latching poles 34 and 36 to stationary contacts 54 and 60, respectively, irrespective of where the poles were previously. When power is next applied in the normal fashion, without reversing the power supply 22 and ground 24, the latching relay will still be in the forced state.

The opposite state could be the one chosen to be the forced state merely by building the circuits with the additional components connected to the opposite coil and capacitor. Thus, diode 92 would be inversely connected across capacitor 82 and the anode of diode 94 and the collector of the transistor 96 would be connected to the coil 48 at the anode of diode 50. The stationary contact 78 of relay 66 would be connected to the coil 42 of latching relay 40 at the anode of diode 44. The principles of operation are unchanged.

An example of the component values that might be used in building the embodiments described herein are as follows, assuming the voltage applied to the magnetic flip-flop 8 (the voltage power supply 22 less the voltage drops across resistors 26 and 28 and the cable 16) is +24 VDC:

DPDT Latching Relay 40—Teledyne 422 DD-26
SPDT Normally-Closed Relay 66—Teledyne 431 DD-4K
Capacitors 80 and 82—6.8 uf, 35 V
Diodes 84, 86, 92, 94 and 100—IN 914B
Resistors 88 and 90—6.8 KΩ
Transistor 96—2N2221
Resistor 98—43 KΩ

If the above component values are used, the entire circuit would not add much bulk or power consumption to an existing hydrophone. The two relays are each housed in TO-5 transistor type enclosures. All the circuit elements except the relays and capacitors could be manufactured as an integrated circuit and with the addition of the relays and capacitors could be easily manufactured as a potted module. The first embodiment of the invention, if the element examples are used, would have only a quiescent power consumption of 58 milliwatts.

Obviously many modifications and variations of the present invention are possible in light of the above teachings. It is therefor to be understood that within the scope of the appended claims the invention may be practiced otherwise than as specifically described.

What is claimed and desired to be secured by Letters Patent of the United States is:

1. In combination with electrical equipment of the type obtaining its power from a two-conductor cable, one line connected to the positive side and the other to the ground side of a suitable DC power supply, including at least one switch available for desired switching connections, the improvement comprising:

a non-latching magnetic relay and an associated single-pole, single throw normally-closed switch, the coil of the relay being connected between the positive side and ground of the incoming power cable and one contact of the switch being connected to ground;

a latching magnetic relay having energizing and de-energizing coils and an associated multiple-pole, double-throw switch with at least one double-throw section being the available switch for the desired switching connections, said latching relay having one side of its coils connected together and to the other side of the switch of the non-latching magnetic relay; and network means connected to the contacts of one of the poles, and to the other side of the coils of said multiple pole latching magnetic relay for switching the poles of the relay from one switch contact to the other upon turning on and off of the power source to said cable.

2. The improvement as in claim 1, said networks comprising:

means for storing energy.

3. The improvement as in claim 1, said networks comprising:

means for inhibiting the energizing and deenergizing of the coils of said latching magnetic relay when voltage is applied to the cable; and means for storing energy.

4. The improvement as in claim 3, wherein said energy storage means comprises first and second capacitors.

5. The improvement as in claim 3, wherein said inhibiting means comprises resistance in the paths between the applied voltage and the coils, said resistance limiting the voltage across the coils of the latching magnetic relay to a value insufficient to cause switching of the poles from one respective contact to the alternate respective contact.

6. The improvement as in claim 1, wherein said network means comprises first and second networks, said first network having a series combination of a first resistor having one end connected to the first contact of one of the poles of said latching magnetic relay, a first diode having its anode connected to the other end of said first resistor and a first capacitor having its cathode grounded and its anode connected to both the cathode of said first diode and the energizing coil of said latching magnetic relay, said second network having a series combination of a second resistor having one end connected to the second contact of the same pole of said latching magnetic relay, a second diode having its anode connected to the other end of said second resistor and a second capacitor having its cathode grounded and its anode connected to both the cathode of said second diode, and to the de-energizing coil of said latching magnetic relay, so that if the pole of each switch of said latching magnetic relay is contacting its respective first contact when there is no voltage on the power conductor of said cable, both of said first and second capacitors are then discharged so that when the voltage on the cable conductor supplying the power rises, current flows through said first resistor, said energizing coil and said first capacitor, whereby the switch of the said non-latching magnetic relay opens causing the voltage across said first capacitor to rise to the value of the supplied voltage and when the voltage on the cable conductor falls to near ground potential, the switch of said non-latching magnetic relay closes thereby completing the circuit through the energizing coil of said latching magnetic relay causing said first capacitor to completely discharge through the energizing coil which then results in the pole of each switch of said latching magnetic relay to switch to its respective second contact.

7. The improvement of claim 1, wherein said non-latching magnetic relay has a first diode forward connected in series between the applied power and the coil of said non-latching magnetic relay and a second diode inversely connected in parallel across the coils of said non-latching magnetic relay, said diodes limiting reverse voltages across the coil to values insufficient to damage the coil.

8. The improvement of claim 6, wherein said latching magnetic relay has a third diode forwardly connected in series from the anode of said first capacitor to one side of the energizing coil, a fourth diode inversely connected in parallel across the energizing coil, a fifth diode forwardly connected in series from the anode of said second capacitor to one side of said deenergizing coil and the sixth diode inversely connected in parallel across the deenergizing coil of said latching magnetic relay, said diodes limiting reverse voltages across both coils to values insufficient to damage the coils.

9. The improvement of claim 1, further comprising:

means for forcing said network means to switch the poles of said latching magnetic relay to a predetermined set of respective contacts, said forcing means responsive to the reversal of the power and ground conductors of the power cable.

10. In combination with the hydrophone preamplifier as recited in claim 6 further comprising:

means for forcing said network means to switch the poles of said magnetic latching relay to a predetermined set of respective contacts, said forcing means being responsive to the reversal of the power supplying and grounded conductors of the power cable.

11. The improvement of claim 10, wherein said forcing means comprises:

a third diode inversely connected in parallel across said first capacitor;

a fourth diode having its anode connected to the side of the first coil opposite to that connected to said first capacitor and its cathode connected to both a stationary contact of said non-latching magnetic relay and a side of the second coil opposite to the side connected to said second capacitors;

an NPN transistor having its collector connected to the anode of said fourth diode;

a third resistor connected between ground and the base of said transistor; and a fifth diode having its anode connected to the emitter of said transistor and its cathode connected to the power conductor of said two conductor cable, such that when DC power and ground are reversed, said normally closed magnetic relay is not operated, and said transistor turns on, thus causing current to flow through said third diode, said transistor and said fifth diode to the reversed ground thus causing each pole of said latching magnetic relay to latch to its respective second contact.

12. In combination with electrical equipment obtaining its power supply from a two-line power cable, one line connected to the positive side and one to the ground side of a suitable DC power source, switching means operated by turning the power source on and off comprising:

a non-latching magnetic relay and an associated single-pole, single-throw, normally closed switch, the coil of the relay being connected between the positive side and ground of the incoming power cable and one contact of the switch being connected to ground;

a latching, magnetic relay having two coils and an associated multiple-pole, double-throw switch, at least one double-throw section being available for desired switching connections, the pole of a second section being connected to the positive side of the power cable;

a resistor and a capacitor connected in series, the free end of the resistor being connected to one of the open contacts of said second section of the multiple-pole switch and the free side of the capacitor being connected to ground;

a second resistor and capacitor series-connected combination connected like the first combination between the other open contact of said second section of the multiple-pole switch and ground; and one coil of said latching relay being connected between the non-grounded side of one capacitor and the non-grounded contact of said normally closed switch, and the other coil of said latching relay being connected between the non-grounded side of the other capacitor and the non-grounded contact of said normally closed switch.

13. Switching means as in claim 12 wherein:

the values of each said resistor is such that the voltage across the coil to which it is connected is insufficient to energize the coil to operate the switch before the switch of the non-latching relay operates.

* * * * *